United States Patent [19]

Albright

[11] 4,124,142

[45] Nov. 7, 1978

[54] CONNECTION APPARATUS FOR A VENDING MACHINE

[75] Inventor: Henry J. Albright, West Des Moines, Iowa

[73] Assignee: Fawn Engineering Corporation, Des Moines, Iowa

[21] Appl. No.: 806,738

[22] Filed: Jun. 15, 1977

[51] Int. Cl.[2] ..... G07F 11/36

[52] U.S. Cl. ..... 221/75

[58] Field of Search ..... 221/75, 76; 194/10; 222/413; 366/320; 62/342

[56] References Cited

U.S. PATENT DOCUMENTS 2,746,730 5/1956 Swenson et al. ..... 366/320 X

*Primary Examiner*—Stanley H. Tollberg

*Attorney, Agent, or Firm*—Henderson, Strom, Sturm, Cepican & Fix

[57] ABSTRACT

A connection apparatus for a vending machine of a type having a helically shaped member which is connected to a drive shaft in a novel manner. A one piece molded plastic member has a hub section for connection to the drive shaft and a plurality of radially extending arms for connection to a convolution of the helically shaped member.

7 Claims, 7 Drawing Figures

CONNECTION APPARATUS FOR A VENDING MACHINE

BACKGROUND OF THE INVENTION

The present invention relates generally to vending machines and more particularly to vending machines of a type including helical members for moving and dispensing articles or packages.

There have been many different structures used to connect such helix to a drive shaft for facilitating selective rotation of such helix. Examples of structures are shown in U.S. Pat. Nos. 3,861,561; 3,883,039; 3,929,255; 3,986,637; and 3,989,163.

Most of such prior art connections have been solid connections made by rivets or the like, to a plate which is then connected to a drive shaft, especially in the helix structures which are formed of flat wire rather than wire of a round cross section. One problem with such prior art structures is that they cannot be adjusted easily, for example to change the rotary position of the helix with respect to the drive shaft.

Another problem with prior art structures is the excessive time and expense of construction and the excessive time needed for disassembly and re-assembly when necessary.

Consequently there is a need for an improved connection structure between the helix and drive shaft of vending machines.

SUMMARY OF THE INVENTION

A connection apparatus for a vending machine of a type utilizing helically shaped members for selectivity delivering items to be vended to the discharge chute of such vending machine by rotation of such helically shaped members. A hub section is utilized for facilitating the attachment to a drive shaft and a plurality of arm members radially extending from the hub section form a connection to a convolution of a helically shaped member.

An object of the invention is to provide a new and improved connection apparatus for connecting a helix of a vending machine to a drive shaft for turning it.

Another object of the invention is to provide a connecting mechanism of the type described which is economical to make, easy to install and dependable in its performance.

A further object of the invention is to provide a connecting mechanism which allows relative adjustment between the helix and the drive shaft.

Other objects, advantages and novel features of the present invention will become apparent from the following detailed description of the invention when considered in conjunction with the accompanying drawings.

DESCRIPTION OF THE PREFERRED EMBODIMENT

Figure 1:
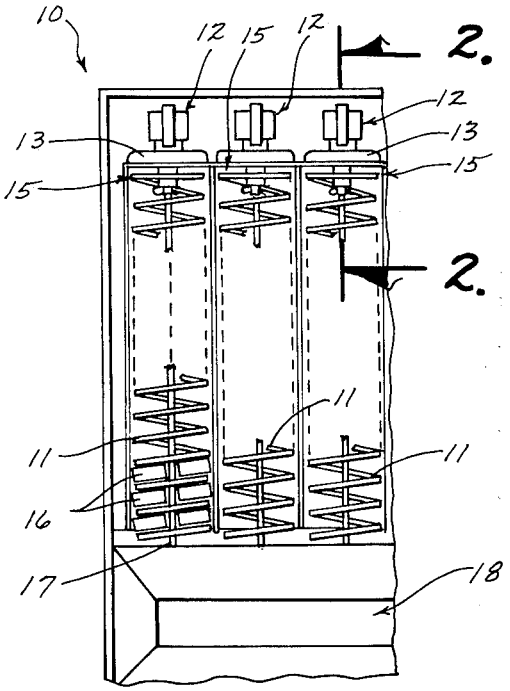
FIG. 1 shows a top plan view of a vending machine utilizing the connection device of the present invention.

Referring now to the drawings wherein like reference numerals designate identical or corresponding parts throughout the several views, FIG. 1 shows a partial cross-sectional view of a vending machine 10 looking down on a number of helix members 11 which are driven by electric motor assemblies 12 through drive train assemblies 13 for rotating a shaft 14 and thereby ultimately rotating the helix 11. A connection device 15 is provided for interconnecting the helix 11 to the shaft 14. Packages 16 are inserted within the convolutions of the helix 11 and on each side of a divider 17, if desired. Actuation of the electric motor 12 to turn the helix by one-half of a revolution thereby allows the forwardmost package 16 to drop into a discharge chute 18 and thereby be delivered to the customer.

Referring now more specifically to the connection device 15 which is the subject of this invention, it is noted that the connection member 15 is preferably molded in one piece from a plastic material such as Deldrin. There is a central hub section 20 for reception of a drive shaft 21 as will be discussed below. The hub section 20 has a central opening 22 disposed therein and a plurality of slots 23 on one side thereof and slots 24 on the opposite side thereof. First and second arm members 26 and 27 extend radially from the hub section 20 in opposite directions. Braces 28 and 29 are connected to the hub 20 and to the arm members 26 and 27 respectively for the purpose of adding strength to this connection. A pair of projections 30 and 31 are connected to the first and second arm members 26 and 27 respectively for reasons which will be explained below. Additionally, third and fourth arm members 32 and 33 extend radially from the hub section 20.

In order to install the connection member 15 onto a helix 11, the helix 11 must first have a pair of openings 34 and 35 disposed therein. The connection member 15 is placed in the position shown in FIG. 2 and 3 by inserting the projections 30 and 31 into the openings 34 and 35 and by bending the resilient arm members 32 and 33 somewhat so that they are disposed on the other side of the convolution from the first and second arm members 26 and 27. The resiliency of the arms 32 and 33 pushing against one side of the convolution of the helix 11 and the other arms 26 and 27 on the other side of the convolution of helix 11 serve to hold the connection member 15 secured within the convolution. The projections 30 and 31 which project through openings 34 and 35 function to prevent the connection member 15 from rotating with respect to the helix 11. It is to be understood however that other means for accomplishing this function are equivalent thereto. Once the connection member 15 has been installed onto the helix 11 as is shown in FIG. 3, then the helix and connection member 15 are placed onto the drive shaft 14 by placing the hub 20 over the drive shaft 14 such that the drive shaft 14 extends through the opening 22 in the connection member 15. Once this has been done, then a pin 36 is placed through an opening 37 through the shaft 21 and through one of the slots 24 in the hub 20. This completes the connection.

Figure 2:
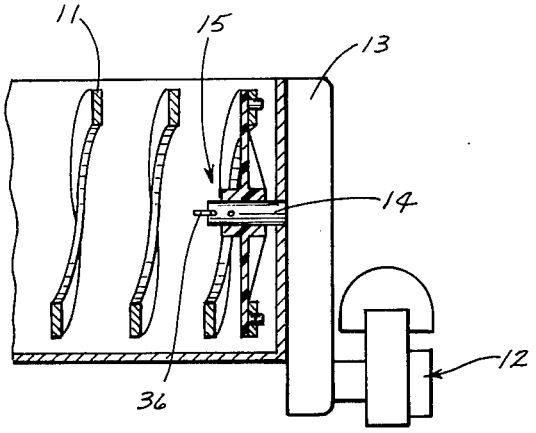
FIG. 2 is an enlarged partial cross-sectional view taken along line 2—2 of FIG. 1.
Figure 3:
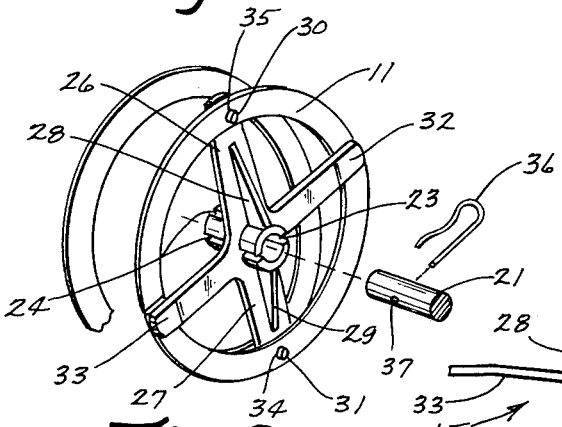
FIG. 3 is a partial perspective view of the present invention installed on the helix of a vending machine.
Figure 4:
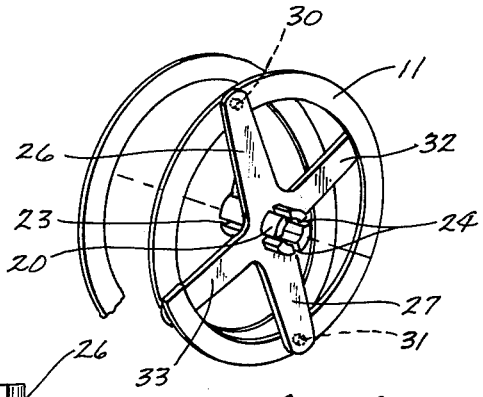
FIG. 4 is a partial enlarged perspective view of the invention installed in a modified fashion on the helix of a vending machine.
Figure 8:
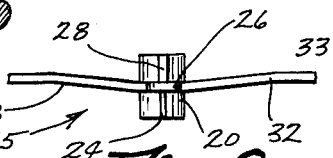
FIG. 8 is a view taken along line 8—8 of FIG. 7.
Figure 5:
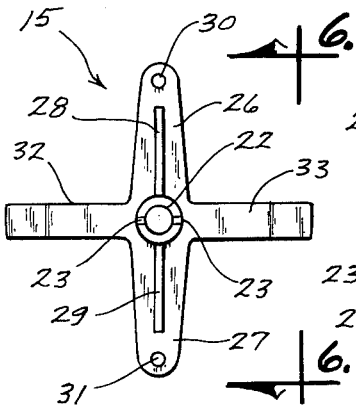
FIG. 5 is a front view of the connection device of the present invention.
Figure 6:
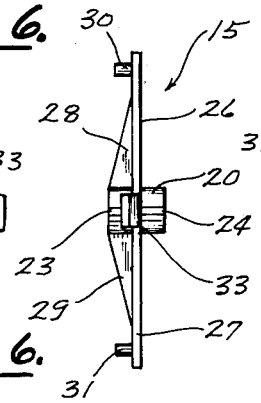
FIG. 6 is a side view taken along line 6—6 of FIG. 5.
Figure 7:
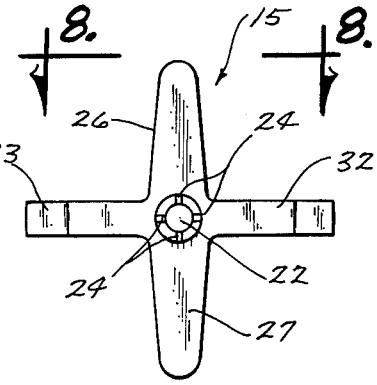
FIG. 7 is a back view of the present invention showing the side opposite FIG. 5.

If it is desired that the helix be oriented 90 degrees with respect to the position of orientation shown in FIGS. 2 and 3, then the connection member 15 is removed from the helix and inserted in a reverse fashion to the position shown in FIG. 4. In this position the arm members 26 and 27 are on one side of the end convolution of the helix 11 and the projections 30 and 31 extend through the openings 34 and 35 but in the opposite direction as in the FIG. 3 installation. The arm members 32 and 33 are on the opposite side of the convolution from arm members 26 and 27 and, as in the instance of the FIG. 3 installation, the arm members 32 and 33 push in opposite directions against the arm members 26 and 27 to hold the connection member 15 securely in place. Once this has been done, then the hub 20 is placed on the shaft 14 and the pin 36 is inserted into the opening 37 in the shaft 21 in the desired orientation.

Obviously many modifications and variations of the present invention are possible in light of the above teachings. It is therefore to be understood that, within the scope of the appended claims the invention may be practiced otherwise than as specifically described.

I claim:

1. Connection apparatus for a vending machine comprising:

a helically shaped member, said helically shaped member having a first opening disposed in a convolution on one end thereof, a second opening being disposed in said convolution and oriented 180° from said first opening;

a drive shaft for selectively rotating said helical member;

means for connecting said drive shaft to said helical member comprising:

a hub section;

means for attaching said hub section to said drive shaft;

a first arm member extending radially from said hub section in a first direction to a position on one side of said convolution;

a first projection disposed on one side of the outermost end of said first arm member, said first projection being disposed in said first opening of the helically shaped member;

a second arm member extending radially from said hub section in a second direction opposite to said first direction, and extending to a position on said one side of said convolution;

a second projection disposed on one side of the outermost end of said second arm member, said second projection being disposed in said second opening of the helically shaped member;

a third arm member extending radially from said hub section in a third direction, the outermost end of said third arm member being disposed on the other side of and in abutment with said convolution;

a fourth arm member extending radially from said hub section in a fourth direction, the outermost end of said third arm member being disposed on said other side of and in abutment with said convolution; and at least one of said first, second, third, and fourth arm members being resilient whereby said first and second projections are held tightly in said first and second openings of the helically shaped member.

2. Connection apparatus as defined in claim 1 wherein said connecting means including said hub section and said first second, third and fourth arm members is of a one piece integral construction.

3. Connection apparatus as defined in claim 2 wherein said connecting means is constructed of a resilient plastic material.

4. Connection apparatus as defined in claim 2 wherein said connecting means is constructed of Delrin.

5. Connection apparatus as defined in claim 1 wherein said attaching means comprises a slot disposed in said hub section, a hole in said drive shaft and a pin disposed in said slot and said hole.

6. Connection apparatus as defined in claim 5 wherein a plurality of slots are formed in said hub section whereby the orientation of the helically shaped member with respect to the drive shaft can be changed.

7. Connection apparatus as defined in claim 6 wherein said hub section includes a portion on one side of said first, second, third and fourth arms and a section on the other side of said first, second, third and fourth arms whereby said connecting means can be reversed whereby the third and fourth arm members are disposed on said one side of the convolution and the first and second arm members lie on the other side of the convolution.

* * * * *